United States Patent [19]

Strobush

[11] Patent Number: 4,466,351

[45] Date of Patent: Aug. 21, 1984

[54] IMPACT PROBE MECHANISM FOR AMMUNITION FUZING

[75] Inventor: Victor H. Strobush, Hennepin County, Minn.

[73] Assignee: Honeywell Inc., Minneapolis, Minn.

[21] Appl. No.: 391,667

[22] Filed: Jun. 24, 1982

[51] Int. Cl.[3] ..... F42C 1/02

[52] U.S. Cl. ..... 102/275; 102/239

[58] Field of Search ..... 102/275, 272, 273, 239, 102/242

[56] References Cited

U.S. PATENT DOCUMENTS

| | | | |
|---|---|---|---|
| 2,137,983 | 11/1938 | Rémondy | 102/275 |
| 2,779,285 | 1/1957 | Küller | 102/275 |
| 3,103,172 | 9/1963 | Hutchison et al. | 102/275 X |
| 3,135,206 | 6/1964 | Hjolm et al. | 102/275 |
| 3,807,307 | 4/1974 | Putscher et al. | 102/275 |
| 3,854,402 | 12/1974 | Kosonocky | 102/275 |
| 3,952,663 | 4/1976 | Forst et al. | 102/275 |
| 4,013,013 | 3/1977 | Davis | 102/275 |
| 4,242,964 | 1/1981 | Warren et al. | 102/275 |

FOREIGN PATENT DOCUMENTS

| | | | |
|---|---|---|---|
| 266134 | 1/1960 | Switzerland | 102/275 |

*Primary Examiner*—David H. Brown

*Attorney, Agent, or Firm*—George W. Field

[57] ABSTRACT

A fuze for firing the explosive charge of a projectile, comprising, in combination, a firing mechanism, including a firing pin, mounted resiliently in said projectile for rearward axial movement of the pin to fire the charge, a probe, including forward and rearward ends and an integral shear washer between the ends, mounted in the projectile with the forward end positioned to receive impact from media traversed by the projectile, with the rearward end slightly spaced forward of the firing mechanism, the washer normally preventing movement of the probe toward the mechanism, so that impact of the fuze with a rigid target shears the washer and enables the probe to engage the mechanism and thereby cause firing of the projectile.

2 Claims, 1 Drawing Figure

IMPACT PROBE MECHANISM FOR AMMUNITION FUZING

The Government has rights in this invention pursuant to Contract No. DAAK30-C-77-0041 awarded by the Department of the Army.

TECHNICAL FIELD

This invention relates to the field of munitions, and more particularly to fuzing mechanisms usable in rounds of ammunition of the size range of 75–160 caliber (20 mm to 40 mm).

BACKGROUND OF THE INVENTION

It is conventional in explosive projectiles to provide a fuzing mechanism effective, when the nose of the projectile impacts the target, to initiate firing of the explosive charge of the projectile. However, experience has shown the conventional firing mechanism is sometimes set off by undesirable impacts, such as those caused by rain in the air or light brush through which the projectile must penetrate before reaching a desired target.

BRIEF SUMMARY OF THE INVENTION

The present invention comprises a firing mechanism which prevents firing of a fuze in response to rain or light brush, but functions reliably against even such intended targets as the light metal skin of an aircraft.

Various advantages and features of novelty which characterize the invention are pointed out with particularity in the claims annexed hereto and forming a part hereof. However, for a better understanding of the invention, its advantges, and objects attained by its use, reference should be had to the drawing which forms a further part hereof, and to the accompanying descriptive matter, in which there is illustrated and described the preferred embodiment of the invention.

BRIEF DESCRIPTION OF THE DRAWING

The single FIGURE of the drawing is a fragmentary longitudinal section of the nose of a projectile in which the invention is incorporated.

DESCRIPTION OF THE PREFERRED EMBODIMENT

Figure 1:
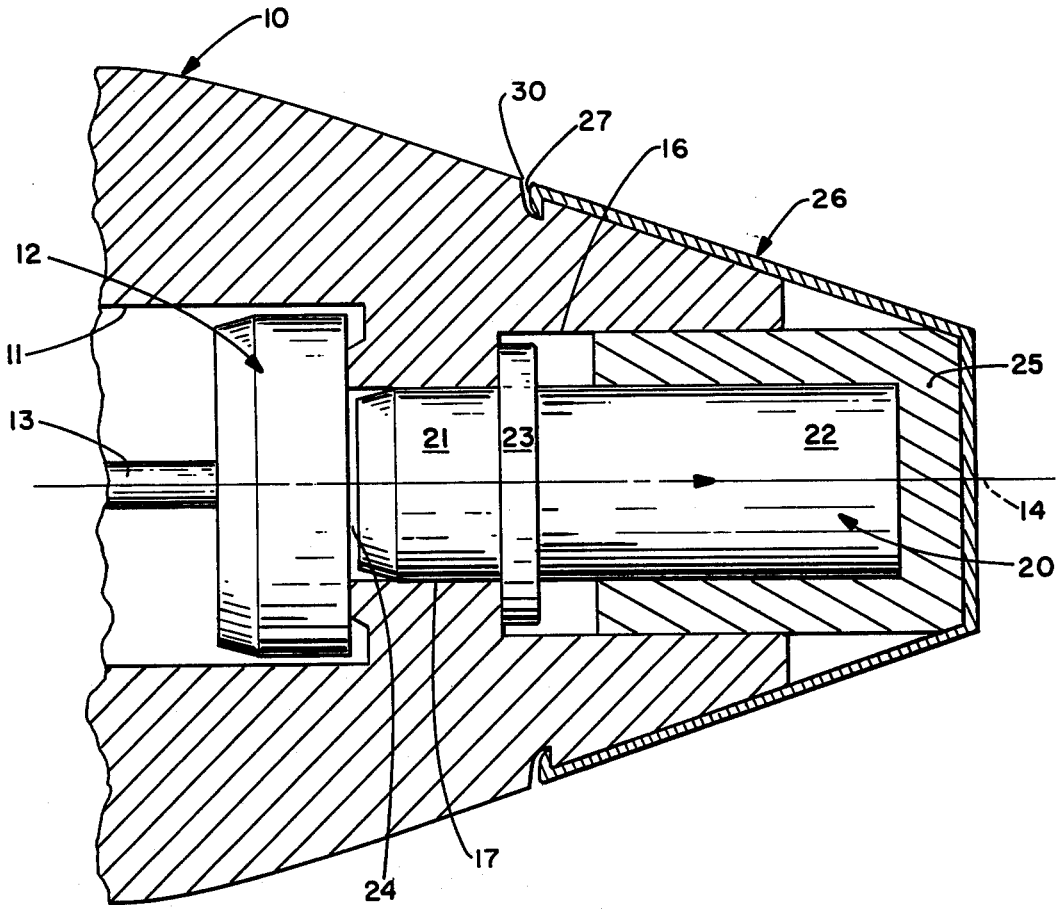

The ogive 10 at the nose of a projectile is shown to include a chamber 11 containing a firing pin mechanism 12 from which a firing pin 13 extends rearwardly along longitudinal axis 14 of the projectile. Movement of pin 13 rearwardly to contact a detonator not shown results in the firing of the explosive charge of the projectile, and is prevented until the projectile is in flight by centrifugal or similar mechanism as is well known in the art.

A second chamber 16 is formed in ogive 10 forwardly of chamber 11, and communicates with chamber 11 by passage 17. A probe 20 is mounted in chamber 17 and has a rearward or free end 21, projecting through passage 17 toward mechanism 12, and a forward end 22. A shear washer 23 is integral with probe 22, which is made of a suitable plastic such as glass filled nylon and maintains a small predetermined air gap 24 between probe 20 and mechanism 12.

The forward end 22 of probe 20 is enclosed in a metal confinement cup 25, and a light protective windshield 26 at the nose of the projectile contacts cup 25 and has an inturned rim 27 which engages a peripheral groove 30 around ogive 10.

OPERATION

In use the projectile is discharged and moves along and spins about axis 14. The pressure of the air, through which the projectile moves, against windshield 26 is substantially uniform, and has no effect on the mechanism, but an impact of the projectile against any material medium sends a shock wave axially through the probe, to produce a deflection at the rearward end 21 thereof. If the medium is light material, such as raindrops or light brush, the impacts are not sufficient for deflection of the probe to cause engagement of end 21 with firing mechanism 12, and no motion of pin 13 occurs: likewise the impact mass under these conditions is not sufficient to shear collar 23.

If the medium is a light metal target, the impact is sufficient for the resulting deflection of the rearward end of the probe to contact the firing mechanism in a "billiard ball" effect, which causes firing of the projectile even though collar 23 may not be sheared. Cup 25 channels the shock wave to pass axially through the probe.

Against heavier, rigid targets windshield 26 is deformed and the impact acts through cup 25 on probe 20 to shear washer 23 and force the probe inward, thus actuating mechanism 12 to cause movement of pin 13 and fire the projectile. Here cup 25 acts to prevent lateral flow of the plastic in probe 20 under the forces acting, and so ensure that those forces do not merely result in distortion of the forward end of the probe, but are transmitted axially so as to shear washer 23.

In one satisfactory embodiment of the invention probe 20 was made of 40 percent glass filled nylon with a diameter of 0.20 inches, washer 23 was 0.072 inches in thickness, the frontal contact area of windshield was 0.07 square inches, and the spacing between probe 20 and firing mechanism 12 was 0.009 inches.

From the foregoing it will be evident that the invention comprises a firing mechanism which is insensitive to frontal contact less than a force predetermined by the design of a shear washer and by the spacing between a probe and the firing mechanism of the fuze.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

The embodiments of the invention in which an exclusive property or right is claimed are defined as follows:

1. In a fuse for firing the explosive charge of a projectile, in combination:

a firing mechanism mounted in said projectile for rearward axial contact to fire said charge;

a plastic probe extending between a forward end and a rearward end;

and means mounting said probe axially in said projectile with said rearward end slightly spaced forward of said mechanism and with said forward end positioned to receive impacts transmitted from media traversed by said projectile, so that a momentary impact produces a shock wave in said probe to cause engagement of said rearward end with said firing mechanism to fire said charge, the spacing between said rearward end and said mechanism determining the magnitude of an impact which is sufficient to cause said firing of said charge.

2. A fuse according to claim 1 further including a confinement cup transmitting impacts to said forward end of said probe and directing the resultant shock wave generally axially of said probe.

* * * * *